US011399641B1

(12) United States Patent
Garriott

(10) Patent No.: US 11,399,641 B1
(45) Date of Patent: Aug. 2, 2022

(54) DEVICE FOR HANGING OBJECTS ON A VERTICAL SURFACE AND A METHOD OF USING THE SAME

(71) Applicant: Wayne Douglas Garriott, San Antonio, TX (US)

(72) Inventor: Wayne Douglas Garriott, San Antonio, TX (US)

( * ) Notice: Subject to any disclaimer, the term of this patent is extended or adjusted under 35 U.S.C. 154(b) by 0 days.

(21) Appl. No.: 17/303,097

(22) Filed: May 20, 2021

(51) Int. Cl.
*A47G 1/16* (2006.01)

(52) U.S. Cl.
CPC ..... *A47G 1/1613* (2013.01)

(58) Field of Classification Search
CPC .... A47G 1/162; A47G 1/1686; A47G 1/1606; A47G 1/16; A47G 1/1613
USPC ..... 248/216.4, 220.21, 544
See application file for complete search history.

(56) References Cited

U.S. PATENT DOCUMENTS 2,891,757 A * 6/1959 Lang ..... A47G 1/1606 248/225.11
3,879,873 A 4/1975 Sawyer
3,912,216 A 10/1975 Gano
RE31,799 E 1/1985 Paskerian
4,591,125 A * 5/1986 Bellehumeur ..... A47G 1/1606 248/480
4,712,761 A 12/1987 Wassell
4,883,247 A 11/1989 Crandall
4,998,363 A 3/1991 Vilims
5,328,139 A 7/1994 Barnes
6,053,468 A 4/2000 Francis
6,659,418 B2 12/2003 Lemire
6,962,016 B1 11/2005 Meyer
7,658,362 B2 2/2010 El Haje
7,802,769 B1 9/2010 Lindsey
7,891,124 B1 2/2011 Willis
3,087,180 A1 1/2012 Clayton
8,127,507 B1 * 3/2012 Bilge ..... E04F 13/0814 52/235
9,521,915 B1 * 12/2016 Tanger ..... A47G 1/1606
9,562,361 B2 * 2/2017 Bilge ..... E04F 13/0891
9,609,964 B1 4/2017 Munson
10,856,674 B2 12/2020 Wiggins
10,856,675 B2 12/2020 Voelker et al.
10,900,239 B1 * 1/2021 Bilge ..... E04F 13/083
2003/0038222 A1 2/2003 Holmes
(Continued)

*Primary Examiner* — Christopher Garft
(74) *Attorney, Agent, or Firm* — Dunlap Bennett & Ludwig, PLLC

(57) ABSTRACT

A hanger assembly having separable surface and object brackets that can slidably engage in a nested position without fasteners. The nested position is formed through the engagement of opposing channels of the respective surfaces of the surface and object brackets. The surface bracket has marking tabs for impressing on a vertical surface a selected orientation of the object that is connected to the object bracket, which in turn is nested with the surface bracket. Once the vertical surface is impressed by the marking tabs, the surface and object brackets can be un-nested and the surface bracket mounted to the vertical surface with the guidance impressions left my the marking tabs. Then the surface and object brackets can be re-nested for installation of the object against the vertical surface. The object is not limited to pictures or panels, and can be irregularly shaped articles.

5 Claims, 5 Drawing Sheets

(56) References Cited

U.S. PATENT DOCUMENTS

| | | | | |
|---|---|---|---|---|
| 2006/0266900 | A1* | 11/2006 | May | G09F 15/0006 248/220.22 |
| 2009/0050775 | A1* | 2/2009 | Constantinou | A47G 1/1606 248/489 |
| 2010/0025552 | A1* | 2/2010 | Joines-Novotny | A47B 96/067 248/220.21 |
| 2011/0127396 | A1* | 6/2011 | Parker | A47B 95/008 248/220.21 |
| 2011/0290965 | A1* | 12/2011 | Virgin | A47G 1/1606 248/205.3 |
| 2012/0260549 | A1 | 10/2012 | Andrulewich | |
| 2014/0054435 | A1* | 2/2014 | Chatterjea | G09F 11/30 248/475.1 |
| 2019/0055975 | A1* | 2/2019 | Simic | F16M 13/02 |

* cited by examiner

DEVICE FOR HANGING OBJECTS ON A VERTICAL SURFACE AND A METHOD OF USING THE SAME

BACKGROUND OF THE INVENTION

The present invention relates to wall hangings and, more particularly, a hanging device for hanging wall panels, pictures, and the like on vertical surfaces.

The problem with hanging pictures or panels on vertical surfaces is making and keeping them level and/or aligned with adjacent wall hangings. Specifically, it can be a challenge to keep the wall hanging from shifting out of alignment when disturbances (e.g., people bumping into the wall, loud music, or the like) shake the supporting vertical surface. This is especially difficult with large panels, pictures, or framed objects. For instance, the conventional approach—using nails that engages a wire strung across the back of the picture/object—has all of the above-mentioned difficulties: leveling, aligning, and maintaining its original level and alignment when the vertical surface is subject to movement.

Tellingly, the problem with establishing and maintaining the leveling and aligning pictures/panels has not been resolved with previous patented innovations; these innovations or devices do not work well because it is necessary to premeasure, judge, and readjust endlessly. The currently solutions may be easy enough for a well-trained professional, but not for a novice.

As can be seen, there is a need for an easy-to-use device for hanging objects on vertical surfaces. The hanging device embodied in the present invention will easily mark the proper and exact location for attachment of the object to a vertical surface; and when attached, the object will remain in place, aligned and level. Simply put, the present invention locates, levels, and aligns the wall hanging along a vertical surface and keeps the wall hanging in place.

The present invention provides for a two-piece hanger assembly—a surface portion and an object portion. The object portion is attached to a rear of an object. The surface portion interconnects the object portion to a vertical surface, locking into place with integral integrating nubs. The surface portion has tabs bent to face the vertical surface—some horizontal direction and some vertical direction so that a user positions the hanger assembly against the vertical surface, perfectly leveled with a standard level, align the object with adjacent objects already on the vertical surface (or with the wall markings of other objects the user is hanging in concert). With both combined portions attached to the object the user may gently presses against the object where the hanger assembly is located so that the hanger tabs lightly pierce the vertical surface, leaving small wall markings, thereby locating the position for the installation of the wall hanger, both vertically and horizontally.

The hanger assembly of the present invention may be sufficient for a simple installation, while two hanger assemblies can be used for wider, larger installations; and four (two at the top and bottom) can be used for wall-sized or heavy panels. After the vertical surface has been marked, the user may remove the object portion by disengaging the nubs of the combined portions. The hanger assemblies are then attached to the wall in the designated locations previously marked through first attaching the surface portion with fasteners, and then re-engaging the nubs of the combined portions. Alternatively, colored chalk can be used on the nubs when marking the wall. The object can then be lifted and locked into place where it will remain until removed by selectively engaging the bottom to release the catch of the nubs.

SUMMARY OF THE INVENTION

In one aspect of the present invention, a device includes the following: a surface bracket having a surface mounting plate having one or more first mounting holes; a surface channel extending along a front-facing bottom portion of the surface mounting plate; and a rear-facing surface nub extending along a distal end of the surface channel in such a way as to partially close an upward-facing opening to a void defined by said surface channel; and an object bracket having an object mounting plate; an object channel extending along a rear-facing upper portion of the object mounting plate; a front-facing object nub extending along a distal end of the object channel in such a way that the object nub snugly slides in and out of the void to move between a nested and un-nested position, respectively; and a clearance slot aligned with each of the one or more first mounting holes, wherein each clearance slot is in a vertical leg of the object channel.

In another aspect of the present invention, the device further includes a plurality of marking tabs along a rear-facing surface of the surface mounting plate, wherein the plurality of marking tabs having at least two vertical marking tabs and at least two horizontal marking tabs, wherein each marking tab is elongated, wherein the front-facing object nub and the rear-facing surface nub have dimensionality that prevents moving between the nested position and the un-nested position except in an approximately vertical direction and an approximately horizontal direction; and a plurality of object mounting holes in in the object mounting plate; and a plurality of second mounting holes in the said vertical leg, wherein each object mounting hole aligns with one of the plurality of second mounting holes.

As used in this application, the term "about" or "approximately" refers to a range of values within plus or minus 10% of the specified number. Specifically, approximately vertical/horizontal direction means plus or minus five-degrees relative to an angle of incident defined by an origin (the void) relative the vertical surface.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hanger assembly having separable surface and object brackets that can slidably engage in a nested position without fasteners. The nested position is formed through the engagement of opposing channels of the respective surfaces of the surface and object brackets. The surface bracket has marking tabs for impressing on a vertical surface a selected orientation of the object that is connected to the object bracket, which in turn is nested with the surface bracket. Once the vertical surface is impressed by the marking tabs, the surface and object brackets can be un-nested and the surface bracket mounted to the vertical surface with the guidance impressions left my the marking tabs. Then the surface and object brackets can be re-nested for installation of the object against the vertical surface.

Figure 1:
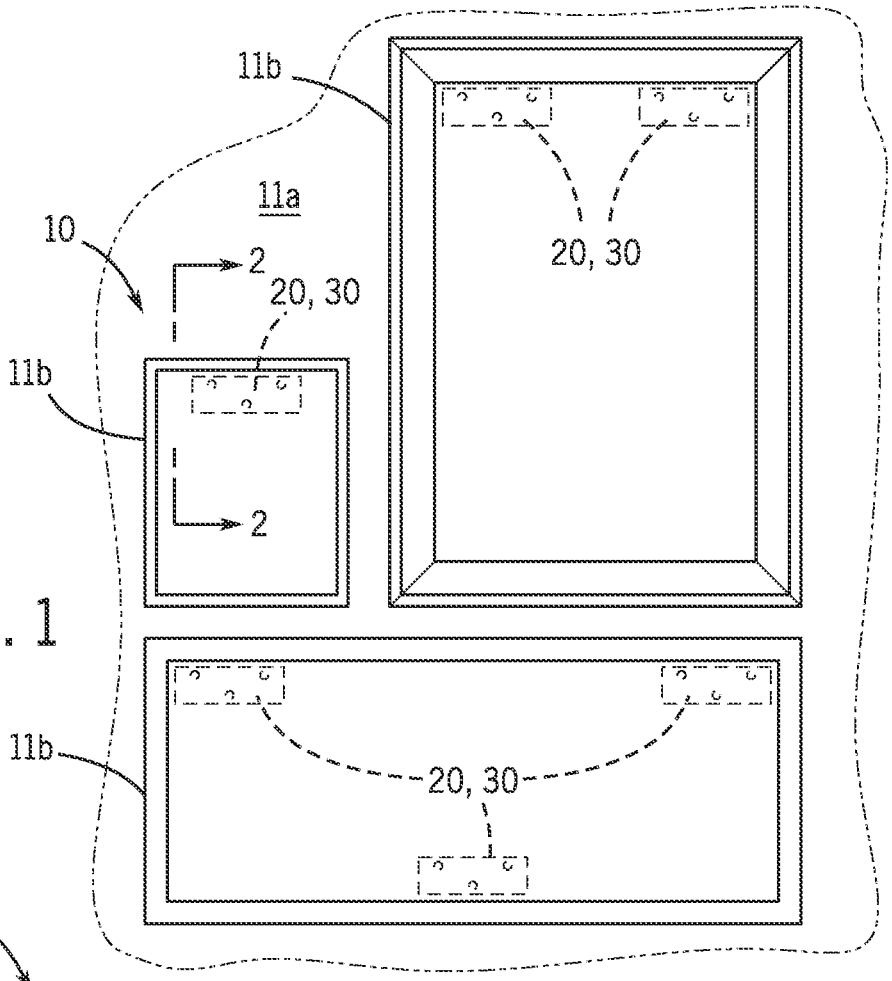
FIG. 1 is a front elevation view of an exemplary embodiment of the present invention, shown in use.
Figure 2:
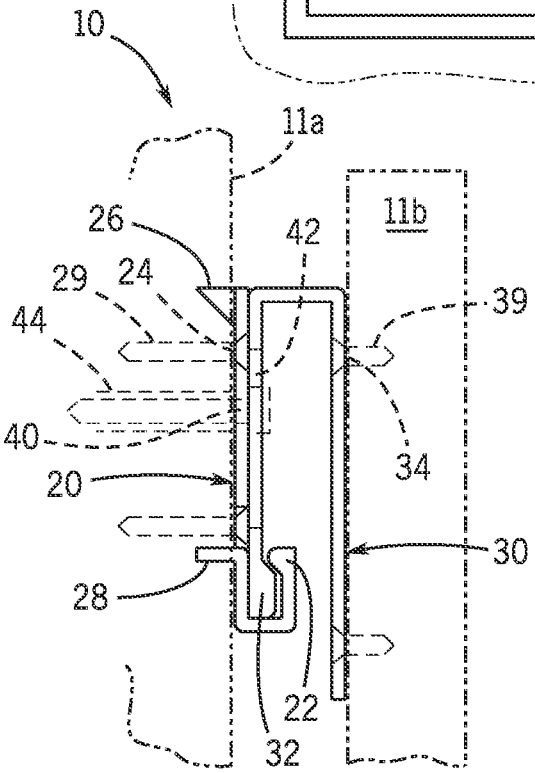
FIG. 2 is a side elevation view of an exemplary embodiment of the present invention, shown in use.
Figure 3:
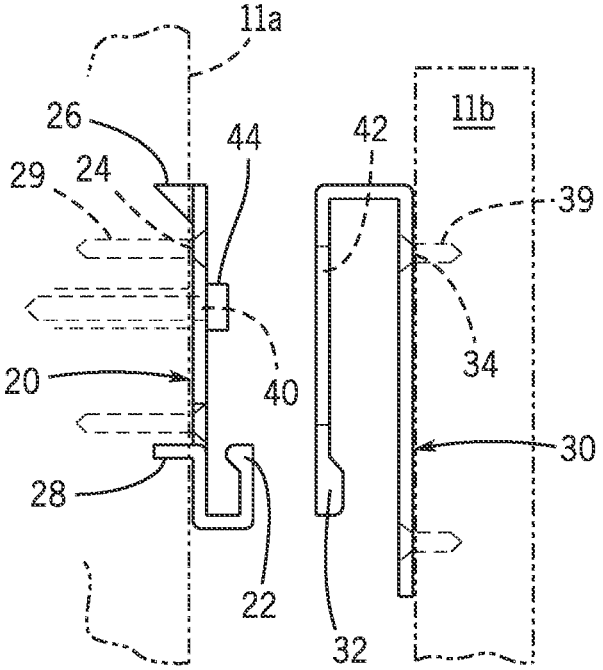
FIG. 3 is a side elevation view of an exemplary embodiment of the present invention, shown in use.
Figure 4:
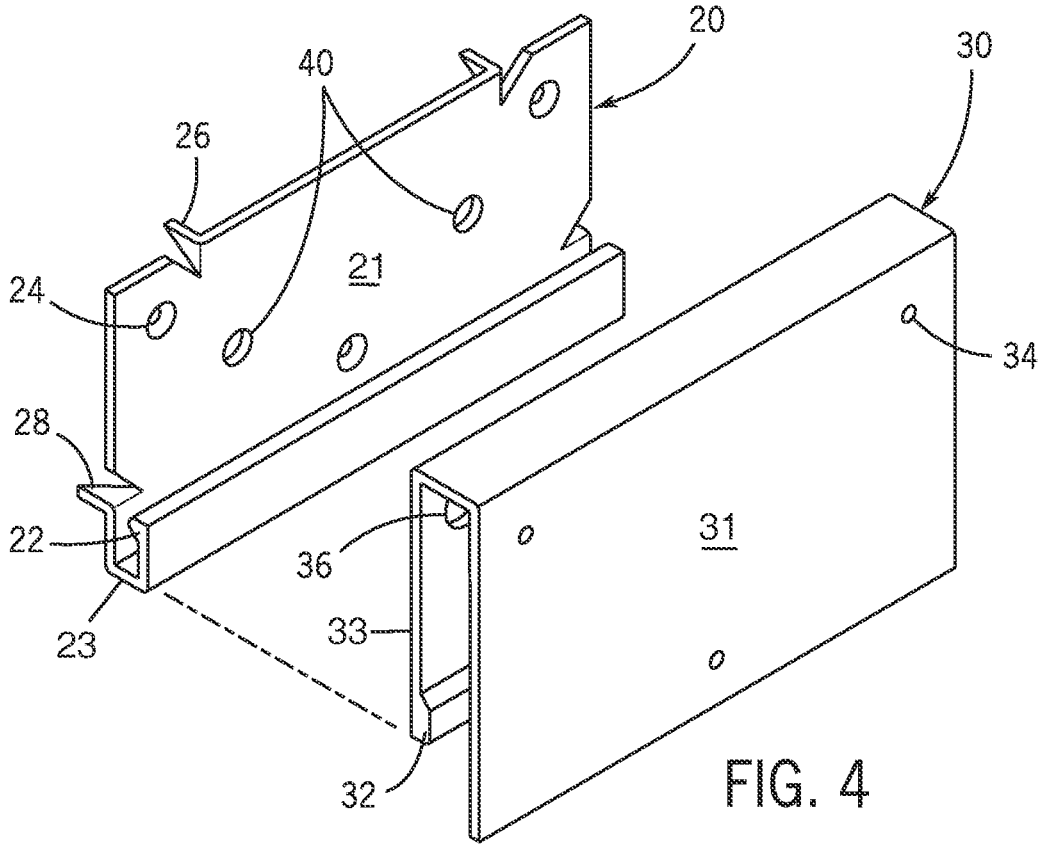
FIG. 4 is a front exploded perspective view of an exemplary embodiment of the present invention.
Figure 5:
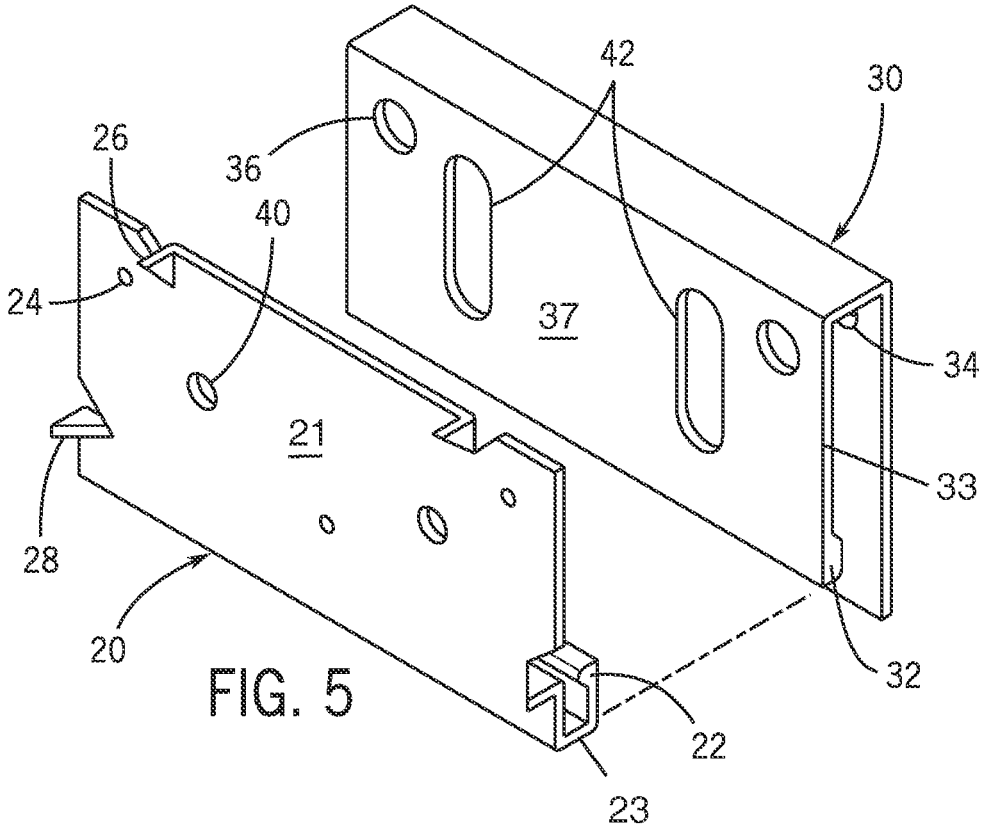
FIG. 5 is a rear exploded perspective view of an exemplary embodiment of the present invention.

It should be understood by those skilled in the art that the use of directional terms such as forward (front), rearward (rear), downward (lower), upward (upper) and the like are used in relation to the illustrative embodiments as they are depicted in the FIGS., wherein the forward direction, relative to the hanger assembly 10, is toward the object 11*b*. In other words, in FIGS. 2 and 3, forward is toward the right margin, rearward is toward the left margin, upward is toward the top margin, and downward is toward the bottom margin. A vertical direction would extend between the upward and downward directions, wherein a horizontal is orthogonal to the vertical direction and the forward and rearward directions (into the drawing sheet).

Referring now to FIGS. 1 through 6K, the present invention may include a hanger assembly 10. The hanger assembly 10 may include two separable pieces: a surface bracket 20 and an object bracket 30.

The surface bracket 20 may have a mounting plate 21 defined by upper and lower longitudinal edges and two opposing side edges. The lower longitudinal edge (or a lower portion) of the mounting plate 21 has a lower channel 23. The lower channel 23 defines a U-shaped member extending along a length of a front face of the mounting plate 21. A distal edge of the lower channel 23 has a rear-facing lower protrusion 22. The mounting plate 21 may have lightweight mounting holes 24 and heavyweight mounting holes 40.

The rear face of the mounting plate 21 may have a plurality of marking tabs: vertical marking tabs 26 and horizontal marking tabs 28. The vertical marking tabs 26 have a cross section that may be elongated (having a length greater than a width, wherein the ratio of length to width is more than 1) wherein the length of the vertical marking tabs 26 is oriented in a vertical direction. The horizontal marking tabs 28 have an elongated cross section wherein the length of the horizontal marking tabs 28 is oriented in a horizontal direction. The vertical marking tabs 26 and horizontal marking tabs 28 may be formed through bent portions of the upper longitudinal edge and the two opposing side edges, respectively. The marking tabs 26 are dimensioned and adapted to leave surface marks 11*c* in a supporting surface 11*a*. The elongated nature of the surface marks 11*c* (a function of the elongated marking tabs 26 and 28) helps facilitate leveling and aligning an object 11*b* with other objects that are not yet installed. Thus, a user can arrange a plurality of objects relative to each other before mounting any of them through using the elongated surface marks 11*c* to get a more accurate leveling reading from a leveling device relative the elongated surface marks 11*c* (as oppose to just connecting two spaced apart point marks).

The object bracket 30 may have a mounting plate 31 defined by upper and lower longitudinal edges and two opposing side edges. The mounting plate 31 may have object mounting holes 34.

An upper channel 33 depends from the upper longitudinal edge (or an upper portion) of the mounting plate 31. The upper channel 33 defines a downward-facing U-shaped member extending along a length of a rear face of the mounting plate 31. A distal edge of the upper channel 33 has a forward-facing upper protrusion 32.

The rear vertical leg 37 of the upper channel 33 may provide vertically oriented heavyweight clearance slots 42 and lightweight access holes 36, which may or may not be aligned with the object mounting holes 34 for attaching the object bracket 30 with an object 11*b*. Both the heavyweight clearance slots 42 and the lightweight access holes 36 provide vertical and/or horizontal tolerance whereby mounting fasteners 29/44 can operatively associate with the rear vertical leg 37 while providing clearance for such mounting fasteners 29/44 during the installation process.

Figure 6A:
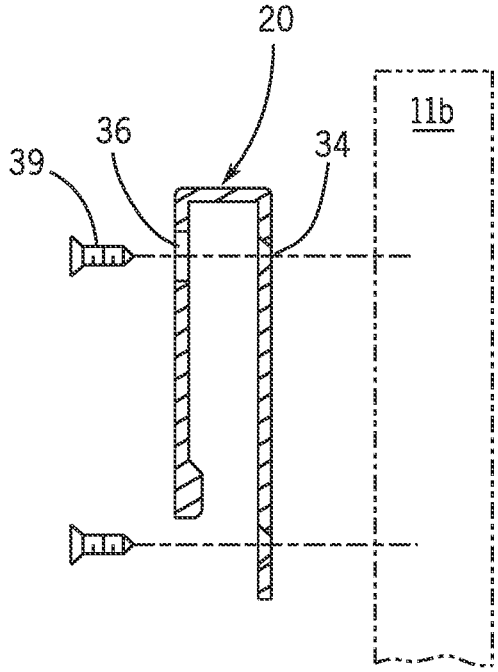
FIGS. 6A-6E show elevation views illustrating an initial assembling and wall marking process of a method of installing an exemplary embodiment of the present invention, in FIGS. 6C and 6D a nested position effectuated by interengagement of a pair of channels is illustrated.
Figure 6B:
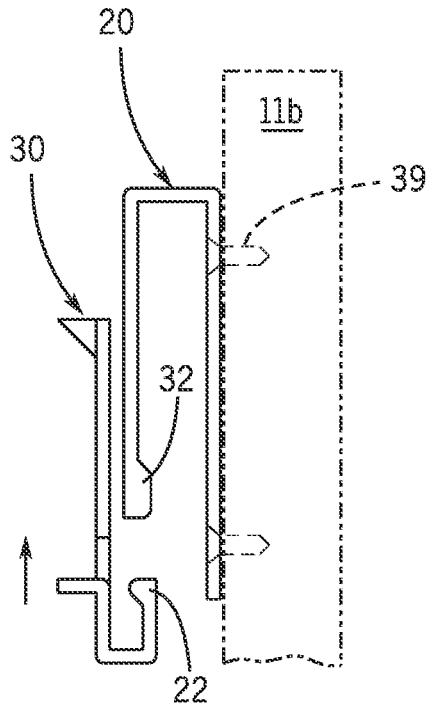
Figure 6C:
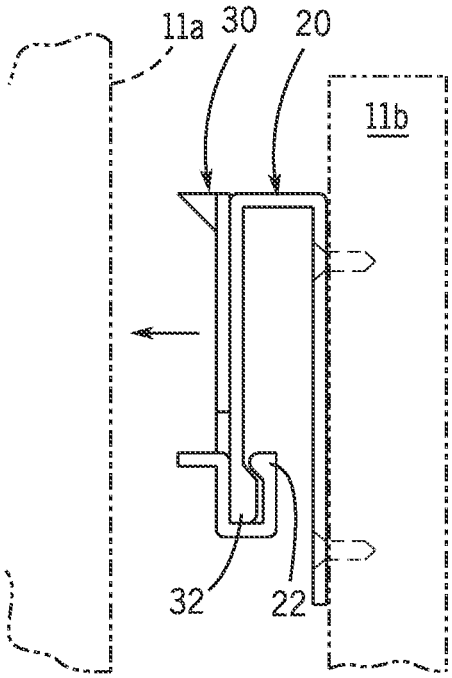
Figure 6D:
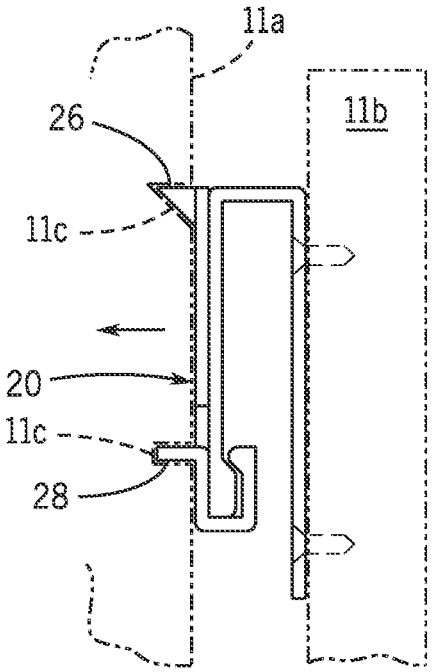
Figure 6E:
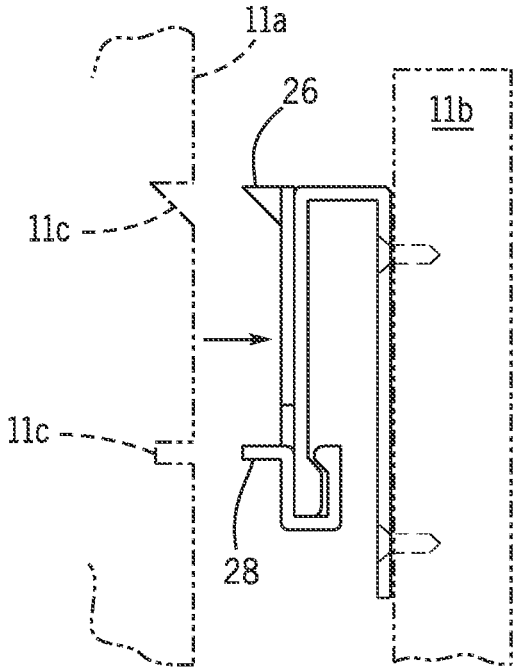
Figure 6F:
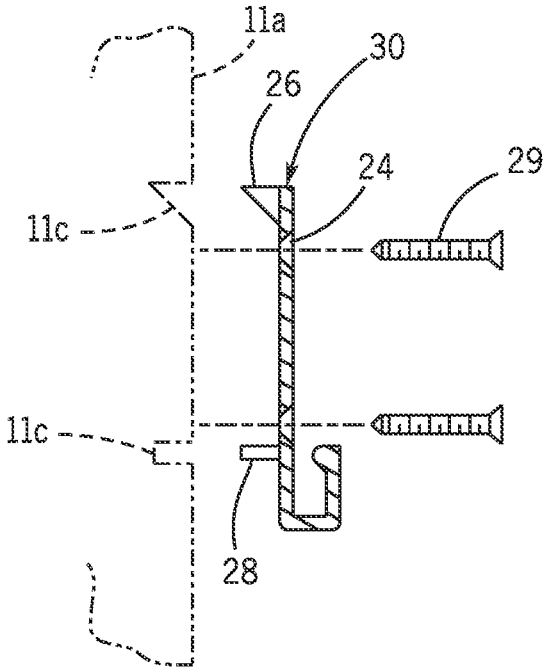
FIGS. 6F-6H show elevation views illustrating a lightweight mounting process of the method of installing an exemplary embodiment of the present invention.
Figure 6G:
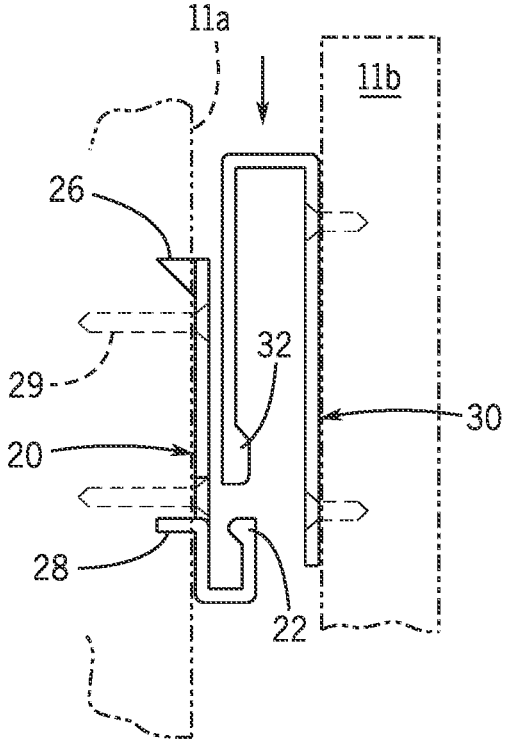
Figure 6H:
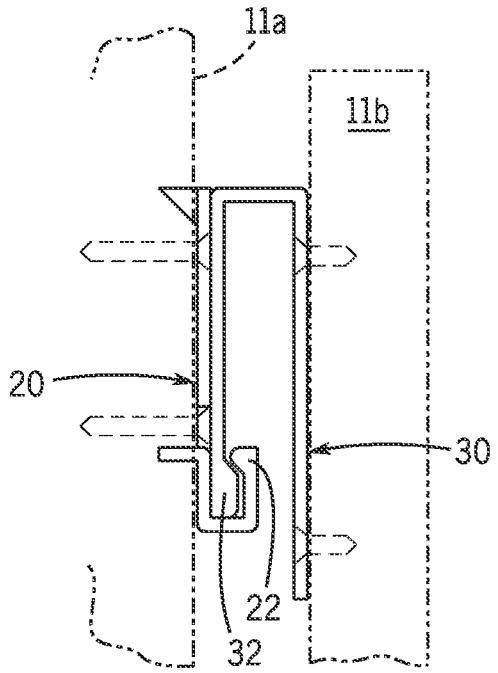
Figure 6I:
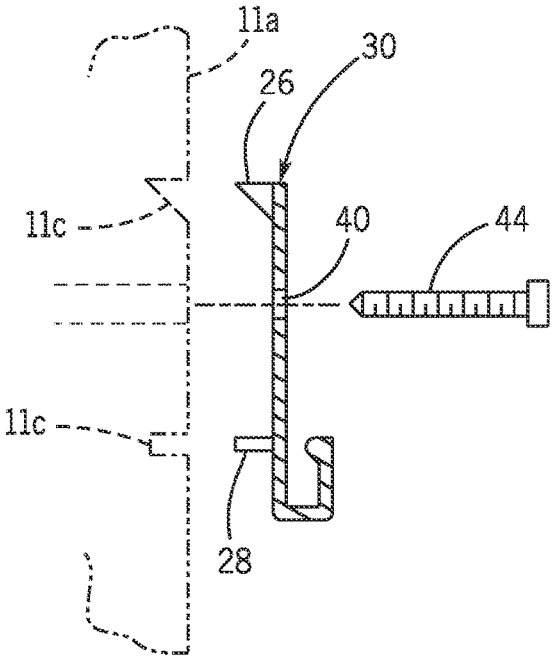
FIGS. 6I-6K show elevation views illustrating a heavyweight mounting process of the method of installing an exemplary embodiment of the present invention.
Figure 6J:
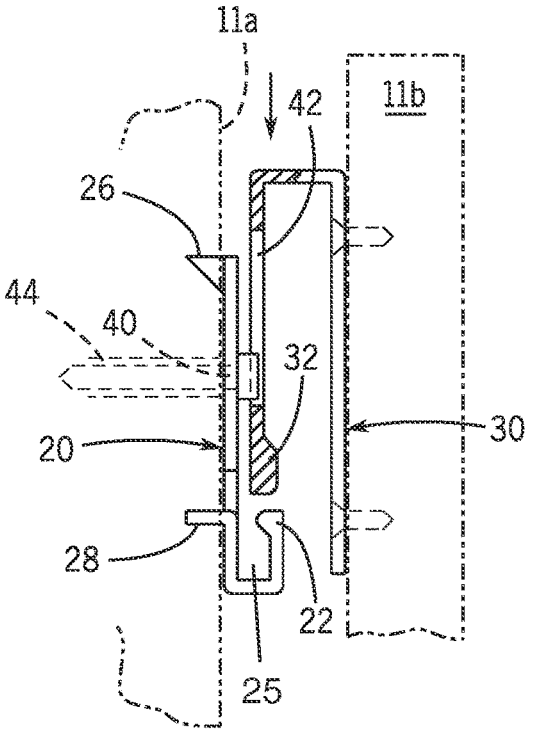
Figure 6K:
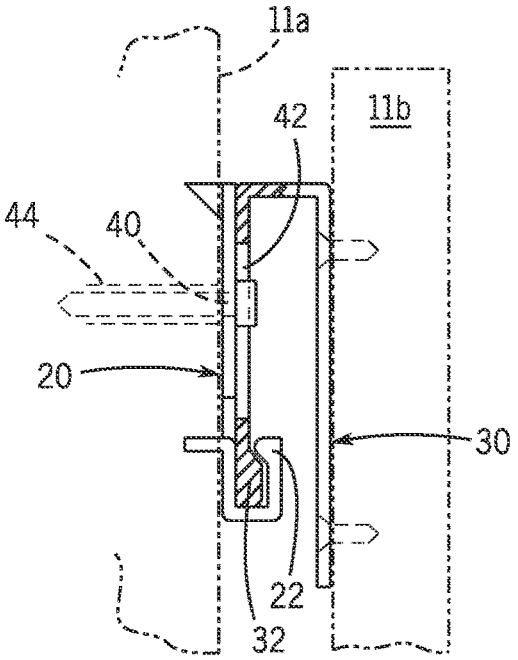

FIGS. 6G and 6H demonstrate how the surface bracket 20 and the object bracket 30 may be readily nested. Particularly, the upper channel 33 of the object bracket 30 rests upon and within (inter-engages) a space defined by the lower channel 23 of the surface bracket 20; specifically, the lower channel 23 and lower protrusion 22 define a cavity 25 dimensioned and adapted to slidably receive the upper protrusion 32 of the upper channel 33 by way of an upward opening to the cavity 25. The lower protrusion 22 acts as an overhang to the cavity 25, and thereby defining the dimensions of said upper opening.

A method of using the present invention may include the following. The hanger assembly 10 disclosed above may be provided.

One novel aspect of the present system is that after mounting the object bracket 30 to the object 11*b*, the surface bracket 30 may nested with the object bracket 30 so that the hanger assembly 10 acts as one. Thus, the object can be selectively leveled and or aligned relative adjacent existing or planned wall hangings, whereby the user may then press the leveled-aligned object 11*b* to cause the marking tabs 26 and 28 of the surface bracket 20 to leave wall markings 11*c*, that can be overlapped at the time of mounting the surface bracket 20 to the vertical surface 11*a*.

Another novel aspect of the present system is that after mounting the surface bracket 20 to the supporting surface 11*a* by way of heavyweight mounting fasteners 40 and mounting the object bracket 20 to the object 11*b* by way of object fasteners 39, the two brackets 20 and 30 are dimensioned and adapted in such a way so that while moving between an un-nested condition (FIG. 6G) and a nested condition (FIG. 6H) that the heads of the heavyweight mounting fasteners 40 protruding from the vertical surface 11*a* are accommodated by the vertical and/or horizontal clearance afforded by the heavyweight clearance slots 42. As a result, the object 11*b* may be quickly hung onto the vertical surface 11*a* without need of a mechanical fastener connecting the two brackets 20 and 30.

It should be understood that the present invention is not limited to pictures or panels as it can also be applied to irregular shaped articles where different methods of attachment (such as glue) can be utilized, where the top is uneven or not level. The present invention can also be used for pieces of furniture such as headboards, shelves, etc. The hanger assembly does not even have to be level to work properly.

The present invention can be manufactured from extruded aluminum or from pressed metal, drilling or pressing screw holes and pressing out tabs.

It should be understood, of course, that the foregoing relates to exemplary embodiments of the invention and that modifications may be made without departing from the spirit and scope of the invention as set forth in the following claims.

What is claimed is:

1. A device comprising:

a surface bracket, comprising:

a surface mounting plate;

a surface channel extending along a front-facing bottom portion of the surface mounting plate; and a rear-facing surface nub extending along a distal end of the surface channel in such a way as to partially close an upward-facing opening to a void defined by said surface channel; and an object bracket, comprising:

an object mounting plate;

an object channel extending along a rear-facing upper portion of the object mounting plate;

the object channel comprising a vertical leg, wherein the vertical leg is generally coextensive with the surface mounting plate;

a front-facing object nub extending along a distal end of the object channel in such a way that the object nub snugly slides in and out of the void to move between a nested and un-nested position, respectively, wherein in the nested position a substantial portion of both the vertical leg and the surface mounting plate uniformly abut; and a plurality of object mounting holes in the object mounting plate; and a plurality of first mounting holes in the vertical leg, wherein each object mounting hole aligns with one of the plurality of first mounting holes.

2. The device of claim 1, further comprising a plurality of marking tabs along a rear-facing surface of the surface mounting plate.

3. The device of claim 2, wherein the plurality of marking tabs comprise at least two vertical marking tabs and at least two horizontal marking tabs.

4. The device of claim 3, wherein each marking tab is elongated.

5. The device of claim 4, wherein the front-facing object nub and the rear-facing surface nub have dimensionality that prevents moving between the nested position and the un-nested position except in an approximately vertical direction and an approximately horizontal direction.

* * * * *